US006697496B2

(12) United States Patent
Frasl

(10) Patent No.: US 6,697,496 B2
(45) Date of Patent: Feb. 24, 2004

(54) ELECTROACOUSTIC TRANSDUCER COMPRISING A MEMBRANE WITH AN IMPROVED PLEATS AREA

(75) Inventor: Ewald Frasl, Biedermannsdorf (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/194,161

(22) Filed: Jul. 11, 2002

(65) Prior Publication Data

US 2003/0112995 A1 Jun. 19, 2003

(30) Foreign Application Priority Data

Jul. 19, 2001 (EP) ..... 01890211

(51) Int. Cl.[7] ..... H04R 25/00

(52) U.S. Cl. ..... 381/398; 381/423; 381/430; 181/171

(58) Field of Search ..... 381/398, 423, 381/424, 430, 432; 181/171, 172, 173, 164, 167, 163, 165

(56) References Cited

U.S. PATENT DOCUMENTS

| | | | | |
|---|---|---|---|---|
| 1,742,265 A | * | 1/1930 | La Rue | 181/173 |
| 3,563,337 A | * | 2/1971 | Kawamura | 181/173 |
| 4,321,434 A | * | 3/1982 | Irie | 381/423 |
| 4,512,435 A | * | 4/1985 | Takeuchi et al. | 181/164 |
| 6,038,327 A | | 3/2000 | Bleim et al. | 381/344 |
| 6,611,604 B1 | * | 8/2003 | Irby et al. | 381/398 |

* cited by examiner

*Primary Examiner*—Huyen Le
(74) *Attorney, Agent, or Firm*—Edward W. Goodman

(57) ABSTRACT

An electroacoustic transducer (1) has a membrane (19), which has a membrane axis (5) and a ring-shaped pleats area (22), the pleats area (22) being provided with a multitude of pleats (26, 27, 28, 32, 33, 34, 38, 39, 40), in which diametrically opposed pleats are embodied differently with regard to at least one of the pleat parameters.

12 Claims, 2 Drawing Sheets

ELECTROACOUSTIC TRANSDUCER COMPRISING A MEMBRANE WITH AN IMPROVED PLEATS AREA

BACKGROUND OF THE INVENTION

1. Field of the Invention

The invention relates to an electroacoustic transducer with a membrane, the membrane having a membrane axis and a ring-shaped pleats area in which a multitude of pleats is provided.

The invention also relates to a membrane for an electroacoustic transducer, the membrane having a membrane axis and a ring-shaped pleats area in which a multitude of pleats is provided.

2. Description of the Related Art

An electroacoustic transducer corresponding to the aforesaid embodiment described in the first paragraph, and a membrane corresponding to the aforesaid embodiment described in the second paragraph, are known, for example, from U.S. Pat. No. 6,038,327. In the solution known from the above-referenced patent, the pleats provided in the pleats area have an identical design throughout the pleats area, i.e., the same mechanical design conditions always recur continually. In other words, this means that all pleats are in conformity with each other with regard to the pleat parameters and, in the known solution, have the same pleat dimensions (length, breadth, depth) and the same pleat cross-sectional shape, namely, essentially a V-shaped pleat cross-sectional shape, and the same pleat pattern, namely, a rectilinear pleat pattern, and the same pleat location in relation to the membrane axis, namely, an almost tangential pleat location. With the known transducer, unfortunately, there is the problem that interference effects on the membrane, which could be caused, for example, due to the fact that non-uniform attaching conditions occur when the membrane is attached to the transducer housing, for example, due to non-uniform adhesive distribution, at certain frequencies could result in unwanted oscillations in the membrane with the result that the oscillating part of the membrane for the generation of sound is no longer oscillated sufficiently precisely parallel to the membrane axis, but an unwanted disruptive movement occurs, generally involving an essentially slewing motion around a swivel axis transverse to and sometimes even exactly perpendicular to the transducer axis, the result of which is that the oscillator coil connected to the membrane does not perform the required movement precisely parallel to the membrane axis, but a movement deviating from this required movement which may have the result that the oscillator coil unfortunately strike parts of the known transducer's magnet system which is closely adjacent to the oscillator coil. In the known transducer, the occurrence of this kind of unwanted disruptive movement may be prevented by feeding less electrical energy to the oscillator coil, but this, in turn, has the drawback that the acoustic energy achievable with the transducer can only be relatively low, so that only a relatively low and, in many applications, for example, in so-called speakerphones, unsatisfactory sound reproduction may be achieved.

SUMMARY OF THE INVENTION

It is the object of the invention to remove the aforesaid problems and develop an improved transducer and an improved membrane.

To achieve the aforesaid object, an electroacoustic transducer is provided with features according to the invention so that an electroacoustic transducer according to the invention may be characterized in the way described below, namely:

An electroacoustic transducer with a membrane, the membrane has a membrane axis and a ring-shaped pleats area, the pleats area being provided with a multitude of pleats, diametrically opposed pleats being embodied differently with regard to a least one of the pleat parameters.

To achieve the aforesaid object, in addition a membrane is provided with features according to the invention so that a membrane according to the invention may be characterized in the way described below, namely:

A membrane for an electroacoustic transducer, the membrane having a membrane axis and a ring-shaped pleats area, a multitude of pleats being provided in the pleats area, diametrically opposed pleats being embodied differently with regard to at least one of the pleat parameters.

The provision of the features according to the invention is a structurally extremely simple way, involving virtually no additional expense, of achieving the object that in a membrane according to the invention for an electroacoustic transducer according to the invention, identical structural relationships in diametrically opposed areas relative to the membrane in the ring-shaped pleats area are deliberately avoided, the result of which is that the formation of a disruptive movement around one or more axes running transverse to or perpendicular to the transducer axis, is counteracted to such a degree that, if there are any at all, only disruptive movements with a very low amplitude can occur and will entail virtually no detrimental consequences, because no unwanted or detrimental impact of the oscillator coil in a transducer according to the invention on the parts of the magnet system surrounding the oscillator coil can take place. This has the advantage that significantly more electrical energy may be fed to the oscillator coil in a transducer according to the invention as compared with the transducer known from U.S. Pat. No. 6,038,327, which advantageously has the consequence that the sound energy (electrical energy) which may be generated with a transducer in accordance with the invention, is much higher and, hence, a much louder sound reproduction may be achieved with a transducer according to the invention.

In a transducer according to the invention, it has been found to be very advantageous if the ring-shaped pleats area is subdivided into ring sectors. Here it has been found to be particularly advantageous, if the ring sectors extend through equally large angular areas. This is a way to achieve a very good suppression of unwanted disruptive movements. As the result of the fact that in a transducer according to the invention, diametrically opposed pleats are always embodied differently with regard to at least one of the pleat parameters, there is always an odd number of ring sectors.

In a transducer according to the invention, in which the ring-shaped pleats area is subdivided into an odd number of ring sectors, there may be five, seven, or even more such ring sectors. However, it has been found to be particularly advantageous if only three ring sectors are provided, each extending through an angular area of 120°. An embodiment of this type has been found to be particularly efficient in tests.

In a transducer according to the invention, the pleats may, for example, have a spiral pattern, which has been known per se for a long time. However, it has been found to be particularly advantageous, if the features, in which the pleat in the middle of a ring sector run linearly in a radial direction, and all other pleats in a ring sector run parallel to the pleat lying in the center of a ring sector and running in a radial direction, are also provided in a transducer according to the invention. An embodiment of this type is characterized by a particularly good acoustic behavior. In addition, an embodiment of this type is characterized in that a particularly good suppression of disruptive movements may be achieved.

With an embodiment of an electroacoustic transducer according to the invention as described in the previous paragraph, it has been found to be particularly advantageous if the features, in which, in every transitional area between two ring sectors, at least one essentially V-shaped transitional pleat is provided of which every pleat limb runs parallel to the adjacent linearly running pleat, are also provided. V-shaped transitional pleats achieve the advantage that sufficient membrane softness is guaranteed in the transitional areas between the ring sectors of the ring-shaped pleats area, which is favorable for good acoustic properties.

The aforesaid advantages in connection with an electroacoustic transducer according to the invention, also apply analogically to a membrane according to the invention.

The aforesaid aspects and further aspects of the invention may be derived from the following examples of embodiments and are described with reference to these examples of embodiments.

BRIEF DESCRIPTION OF THE DRAWINGS

The invention will be further described with reference to embodiments shown in the drawings, to which, however, the invention is not limited, in which.

DESCRIPTION OF THE PREFERRED EMBODIMENTS

Figure 1:
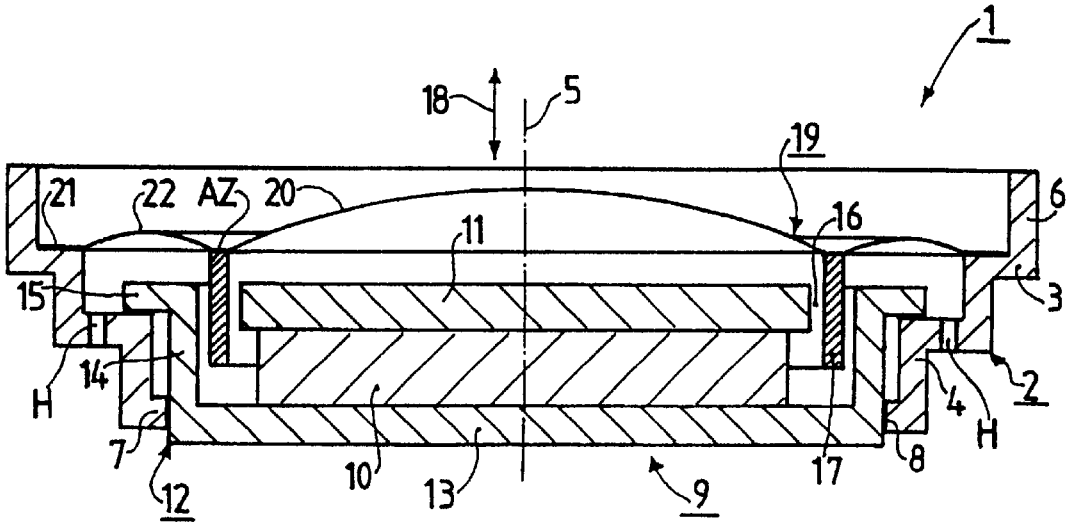
FIG. 1 shows, in a partially schematicized way, in cross-section, an electroacoustic transducer in accordance with one embodiment of the invention, which has a membrane in accordance with one embodiment of the invention.

FIG. 1 shows an electroacoustic transducer 1, hereinafter referred to as transducer 1 for short and which is embodied as a loudspeaker. Transducer 1 has a plastic housing 2 provided with a first bend 3 and a second bend 4, the two bends 3 and 4 merging into each other. In the area of the second bend 4, holes H are provided to connect the so-called rear space with the acoustic free space. The first bend 3 is connected to a hollow cylindrical section of the housing 6 running in the direction of a transducer axis 5. The second bend 4 is connected to a flat section of the housing 7, in which a circular cylindrical opening 8 is provided.

Transducer 1 has a magnet system 9. The magnet system 9 comprises a magnet 10, a pole plate 11 and a pot 12, which is frequently also referred to as an external pot and comprises a pot base 13, a hollow cylindrical pot part 14 and a pot collar 15 protruding radially from the pot part 14. The entire magnet system 9 on the second bend 4 of the housing 2 is attached to the pot collar 15 of the pot 12, with a bonded joint being provided between the pot collar 15 and the second bend 4. From the magnet system 9, the pot 12 and its pot base 13 protrudes through the opening 8 in the flat section of the housing 7 with a mechanically and acoustically tight bond being created between the flat housing section 7 and the pot 12 formed by a press fit, but which may also be achieved by a bonded joint, for example.

Between the circumferential boundary of the pole plate 11 and the end area of the hollow cylindrical part of the pot 14 facing pole plate 11, there is an air gap 16. The air gap 16 partially accommodates an oscillator coil 17 of the transducer 1. The oscillator coil 17 may be oscillated with the aid of the magnet system 9 essentially parallel to the direction of oscillation, indicated in FIG. 1 by a double arrow 18 which runs parallel to the transducer axis 5. The oscillator coil 17 is connected to a membrane 19 in transducer 1, the embodiment of which is described in detail in the following with references to FIGS. 2 to 4. Membrane 19 may be oscillated by means of the oscillator coil 17 essentially parallel to the direction of oscillation 18 and, hence, parallel to the transducer axis 5. It should also be mentioned that the transducer axis 5 also forms a membrane axis of the membrane 19.

Figure 2:
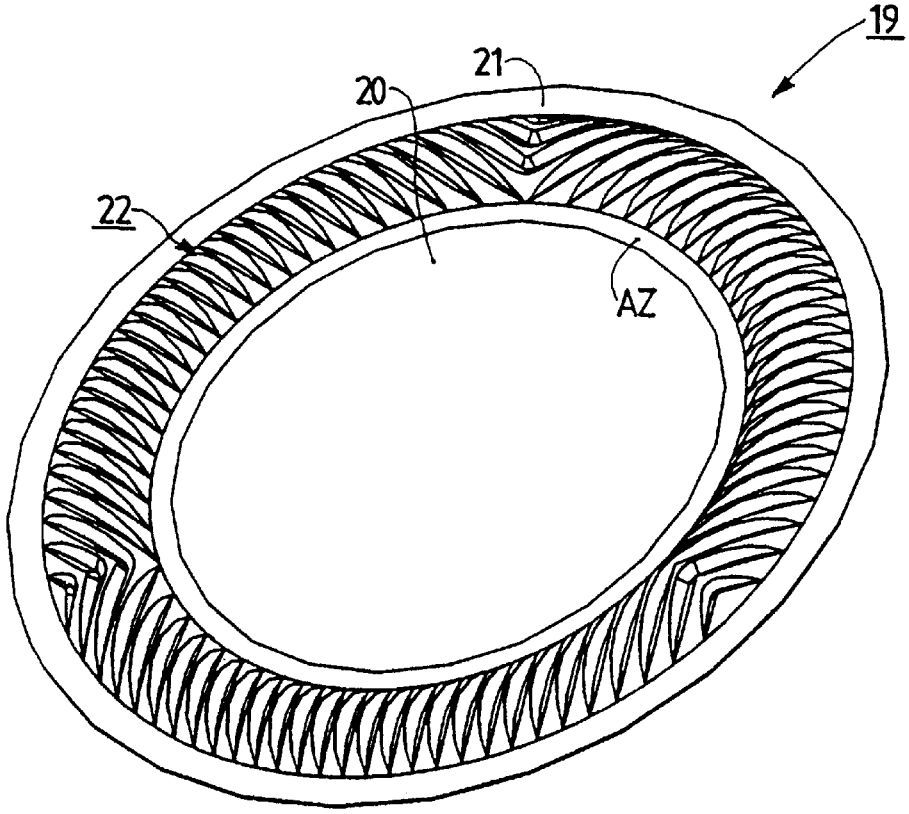
FIG. 2 shows, in an oblique plan view, the transducer's membrane in accordance with FIG. 1.
Figure 3:
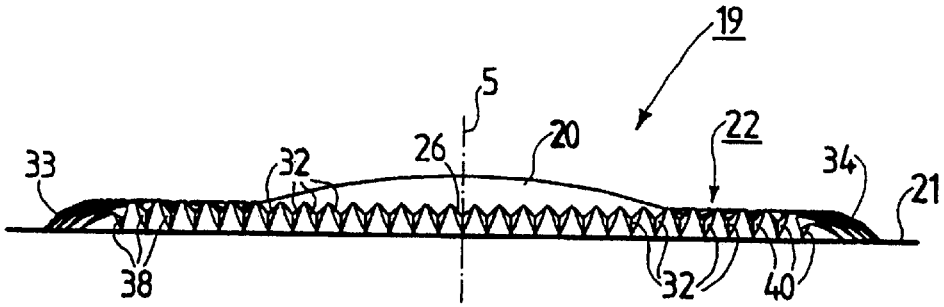
FIG. 3 shows, in a side view, the membrane in accordance with FIG. 2.
Figure 4:
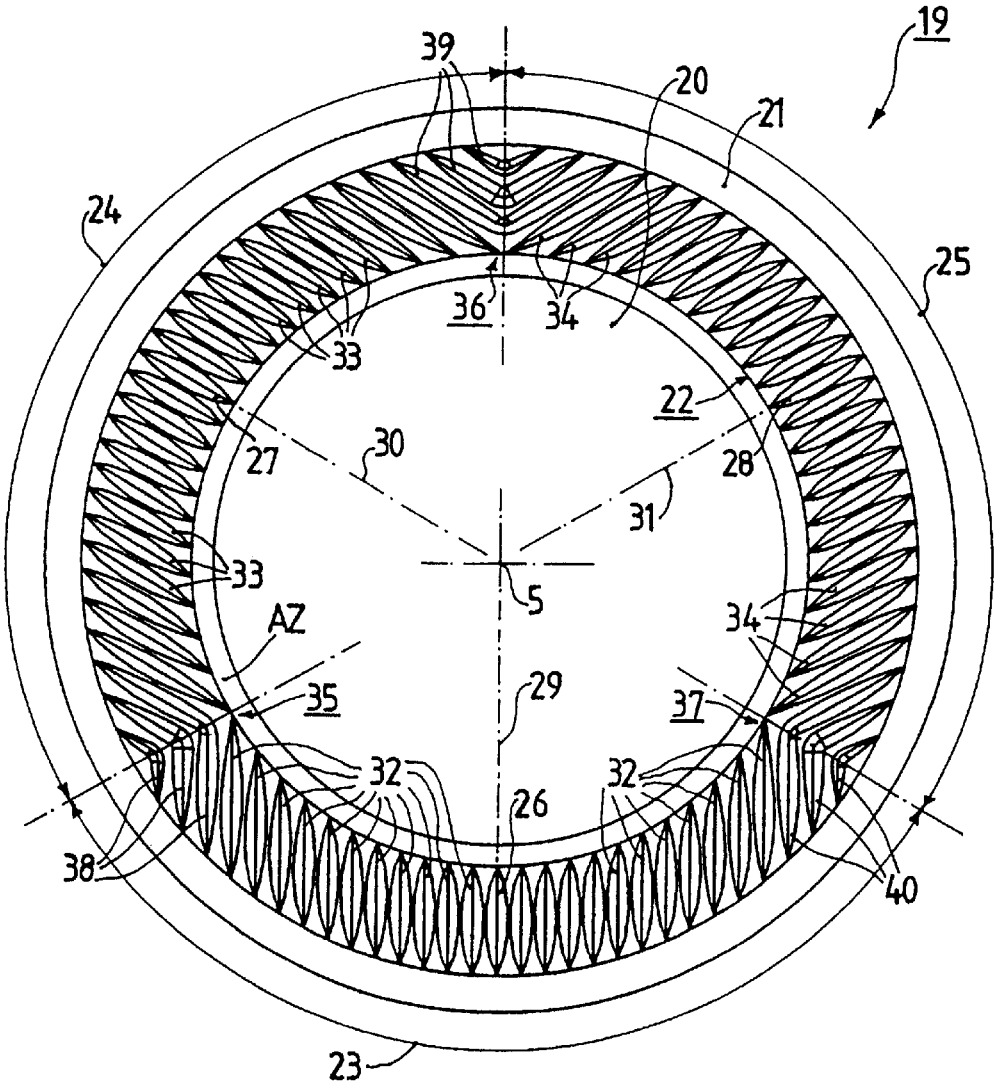
FIG. 4 shows, in a plan view, the membrane in accordance with FIGS. 2 and 3.

The membrane 19, which is only shown schematically in FIG. 1, is described in detail in the following with reference to FIGS. 2 to 4, with the actual embodiment of membrane 19 being shown in FIGS. 2 to 4.

The membrane 19 has the already-mentioned membrane axis 5. The membrane 15 also has a dome-shaped central area 20. In addition, the membrane has a circular ring-shaped external area 21, the external area 21 attaching the membrane 19 to the housing 2 of the transducer 1 in accordance with FIG. 1. Between the central area 20 and the external area 21, a ring-shaped pleats area 22 is provided which, in this case, has a circular ring-shaped embodiment and is directly adjacent to the external area 21, with a connecting area AZ being provided between the central area 20 and the pleats area 22, which is used to attach the oscillator coil 17.

In the pleats area 22, a multitude of pleats is provided and this will be described in more detail in the following. At this point, it should be mentioned that in specialist circles, the term "crimped area" is often used instead of the term "pleats area". In this case, the word "crimps" is used instead of "pleats". In English, the word "pleats" is used.

With membrane 19, in a particularly advantageous way, the embodiment is designed so that diametrically opposed pleats are embodied differently with regard to at least one of the pleat parameters. In addition, the embodiment is designed so that the pleats area 22 is divided into ring sectors 23, 24, 25, with the ring sectors 23, 24, 25 extending through equally large angular areas, and in this particular case, through angular areas of 1200 each, because, with the membrane 19, the ring-shaped pleats area is divided into three ring sectors 23, 24, 25.

As already stated above, in the membrane 19, diametrically opposed pleats are embodied differently with regard to at least one of the pleat parameters. These parameters are the pleat dimensions, i.e., the pleat length, the pleat breadth, the pleat depth, and the pleat cross-section, which may be V-shaped or U-shaped with rounded transitional areas or U-shaped with angular transitional areas, and the pleat pattern, which may be linear or spiral, and the pleat location in relation to the membrane axis 5, which may be radial or tangential or somewhere in between.

With the membrane 19, the embodiment is designed so that diametrically opposed pleats are embodied differently with regard to the pleat length and the pleat location in relation to the membrane axis 5. With the membrane 19, every pleat 26, 27, 28 in the center of a ring sector 23, 24, 25 runs linearly in a radial direction 29, 30, 31. In addition, all other pleats 32, 33, 34 of a ring sector 23, 24, 25 run parallel to the pleat 26, 27, 28 lying in the center of a ring sector 23, 24, 25 and running in a radial direction 29, 30, 31. In addition, with the membrane 19, the embodiment is designed so that in every transitional area 35, 36, 37, three essentially V-shaped transitional pleats 38, 39, 40 are provided between two ring sectors 23, 24 and 24, 25 and 25, 23, of which every pleat limb runs parallel to the adjacent linearly running pleat 32, 33 or 33, 34 or 34, 32.

As a consequence of the aforesaid embodiment of the membrane 19, in the ring-shaped pleats area 22, identical structural relationships in diametrically opposed areas in relation to the membrane axis 5 are deliberately avoided, the consequence being that the occurrence of a disruptive movement about one or more axes transverse to the membrane axis 5 is counteracted to such a degree that, if there are any at all, only disruptive movements with a very low amplitude can occur, but entail virtually no detrimental consequences.

With the aforesaid solution explained with reference to FIGS. 1 to 4, the pleats area 22 has a precise circular ring-shaped embodiment. This must not necessarily be the case, because a pleats area 22 of this type may also have a ring-shape which deviates from a precise circular ring shape, for example, the shape of a ring with an internal boundary and an external boundary, with both boundaries being embodied in accordance with a so-called constant thickness or constant breadth.

With the aforesaid membrane 19 described with reference to FIGS. 2 to 4, all pleats run linearly. Once again, this does not necessarily have to be the case, because the pleats could also follow another pattern, for example, a spiral pattern. In addition, it should be mentioned that with the aforesaid membrane 19, all the pleats are essentially equally high. Once again, this does not necessarily have to be the case, because the pleat height may also vary. With the aforesaid membrane 19, all pleats have the same pleat cross-sectional shape. Once again, this does not have to be the case, because a membrane may also be provided with pleats with a V-shaped and a U-shaped cross section.

The aforesaid membrane 19 comprises one piece and is produced by means of a deep-drawing process. However, a membrane according to the invention may also comprise several parts connected to each other, for example, by bonding, laser welding or ultrasound welding.

What is claimed is:

1. An electroacoustic transducer having a membrane, said membrane comprising a dome-shaped central area, a circular ring-shaped external area, a membrane axis and a ring-shaped pleats area between the dome-shaped central area and the circular ring-shaped external area, said ring-shaped pleats area containing a multitude of pleats having pleat parameters including pleat dimensions, pleat cross-section, pleat pattern and pleat location, wherein diametrically opposed pleats of said multitude of pleats in said ring-shaped pleats area are embodied differently with regard to the pleat parameters.

2. The electroacoustic transducer as claimed in claim 1, wherein the ring-shaped pleats area is subdivided into ring sectors.

3. The electroacoustic transducer as claimed in claim 2, wherein the ring sectors extend through equally large angular areas.

4. The electroacoustic transducer as claimed in claim 3, wherein the ring-shaped pleats area is subdivided into three ring sectors, each of said three ring sectors extending through an angular area of 120°.

5. The electroacoustic transducer as claimed in claim 2, wherein the pleat in the middle of a ring sector extends linearly in a radial direction, and all other pleats in said ring sector extend parallel to the pleat in the middle of said ring sector.

6. The electroacoustic transducer as claimed in claim 5, wherein the ring-shaped pleats area further comprises transitional areas between each of the three ring sectors, each of said transitional areas containing at least one transitional pleat having two limbs formed in a V-shape, each of said two limbs running parallel to an adjacent linearly running pleat.

7. A membrane for an electroacoustic transducer, said membrane comprising a dome-shaped central area, a circular ring-shaped external area, a membrane axis and a ring-shaped pleats area between the dome-shaped central area and the circular ring-shaped external area said ring-shaped pleats area containing a multitude of pleats having pleat parameters including pleat dimensions, pleat cross-section, pleat pattern and pleat location, wherein diametrically opposed pleats of said multitude of pleats in said ring-shaped pleats area are embodied differently with regard to the pleat parameters.

8. The membrane as claimed in claim 7, wherein the ring-shaped pleats area is divided into ring sectors.

9. The membrane as claimed in claim 8, wherein the ring sectors extend through equally large angular areas.

10. The membrane as claimed in claim 9, wherein the ring-shaped pleats area is subdivided into three ring sectors, each of said three ring sectors extending through an angular area of 120°.

11. The membrane as claimed in claim 8, wherein the pleat in the middle of a ring sector extends linearly in a radial direction, and all other pleats in said ring sector extend parallel to the pleat in the middle of said ring sector.

12. The membrane as claimed in claim 11, wherein the ring-shaped pleats area further comprises transitional areas between each of the three ring sectors, each of said transitional areas containing one transitional pleat having two limbs formed in a V-shape, each of said two limbs running parallel to an adjacent linearly running pleat.

* * * * *